US005105856A

United States Patent [19]

Wahhoud

[11] Patent Number: 5,105,856

[45] Date of Patent: Apr. 21, 1992

[54] GUIDE MECHANISM FOR TENSIONING A WEFT THREAD PRESENTED TO A CUTTER

[75] Inventor: Adnan Wahhoud, Lindau, Fed. Rep. of Germany

[73] Assignee: Lindauer Dornier Gesellschaft mbH, Lindau, Fed. Rep. of Germany

[21] Appl. No.: 639,687

[22] Filed: Jan. 10, 1991

[30] Foreign Application Priority Data

Jan. 13, 1990 [DE] Fed. Rep. of Germany ..... 4000856

[51] Int. Cl.[5] ..... D03D 47/34

[52] U.S. Cl. ..... 139/194; 139/302; 139/450

[58] Field of Search ..... 139/291 C, 303, 302, 139/429, 194, 450

[56] References Cited

U.S. PATENT DOCUMENTS 4,275,773 6/1981 Shibata ..... 139/194 X 4,784,188 11/1988 van Mullekom ..... 139/302

FOREIGN PATENT DOCUMENTS 3803146 4/1989 Fed. Rep. of Germany .

*Primary Examiner*—Andrew M. Falik

*Attorney, Agent, or Firm*—W. G. Fasse

[57] ABSTRACT

A guide mechanism for presenting a weft thread to a cutter, especially in an air jet loom, has a weft thread guide pin which is driven up and down in synchronism with the beat-up motion of a loom slay, so that a beat-up weft thread is stretched by the guide pin either due to the return motion of the slay or by a horizontal motion component imparted to the guide pin in addition to its vertical movement. During the forward stroke of the beat-up motion of the slay the guide pin is out of the way of the weft thread. The cutting takes place when the weft thread is stretched across the cutter. The return motion of the slay and a forward motion of the guide pin can be combined for applying the proper tension to the weft thread to be cut.

9 Claims, 6 Drawing Sheets

GUIDE MECHANISM FOR TENSIONING A WEFT THREAD PRESENTED TO A CUTTER

FIELD OF THE INVENTION

The invention relates to a guide mechanism for presenting the weft thread to a cutter, such as scissors, in a weaving loom, especially an air jet weaving loom.

BACKGROUND INFORMATION

In air jet weaving looms the above mentioned cutter is arranged on the weft thread insertion side downstream of the main air jet nozzle as viewed in the insertion direction. The cutter is arranged next to the beat-up line for cutting the weft thread when the beat-up motion of the loom slay is completed and when the loom shed has been changed so that the inserted weft thread is securely held in the fabric by the warp threads. The cutting must take place at the very beginning of the return motion of the slay, so that the air insertion channel, specifically the main air jet nozzle is ready for the next weft thread insertion when the loom slay reaches the weft thread insertion position. The proper cutting including the timing of the cutting of the weft thread has presented substantial problems heretofore.

Although scissors type cutters are used conventionally, these cutters cannot properly cut the weft thread if the weft thread is not properly presented for the cutting. For example, proper cutting is not assured if the weft thread extends across the cutting edges with a slant rather than perpendicularly to the cutting edges or if the weft thread does not have the proper tension for the cutting.

In air jet weaving looms the main weft thread inserting nozzle is secured to the loom slay and hence moves along with the loom slay in the beat-up motion. The weft thread passes through the main nozzle coming from a weft thread storage through a thread guide for properly leading the weft thread into the main nozzle. Relay nozzles are arranged alongside the weft thread insertion channel through the reed and these relay nozzles carry the weft thread through the air insertion channel and thus through the loom shed. When the insertion is completed, the slay performs the beat-up motion, whereby the main nozzle travels along with the slay as mentioned, into the position defined by the beat-up line. At this point of time, there is a section of weft thread extending from the fabric edge to the weft thread storage through the main nozzle. The tension on this section of weft thread depends on the instantaneous position of the loom slay and thus of the movement of the main nozzle as the loom slay travels back into the weft thread insertion position. The highest tension in the weft thread is present at the moment of beat-up. The tension slackens again as the slay begins its return movement.

It is desirable to cut the weft thread when it has its optimal tension. For this purpose, the cutter in an air jet loom is mounted in a fixed position next to the beat-up line.

Tests made by the inventor have shown that the cutting of the weft thread also depends on the yarn characteristics or qualities. For many types of yarns the tension present in the weft thread at the beginning of slay return from the beat-up line is insufficient to assure a proper cut. One reason for this difficulty resides in the fact that the thread inside the main nozzle has a tendency to flutter, since the inner diameter of the main nozzle is larger than the thread diameter. The thread nozzle inner diameter is, for example, within the range of 3 to 4 mm. Thus, the air flow through the nozzle can cause the weft thread to flutter. As a result, it was possible heretofore for the weft thread to slide below the cutter and thus not be cut at all.

Even with the weft thread still extending across the cutting blades of the scissors, a proper cut is not assured if the tension is insufficient so that the closing scissors blades just squeeze the weft thread to produce a fuzzy cut, rather than a clean cut. Both thread ends then may have a fuzzy appearance and this is undesirable, especially for the weft thread end that must next be transported through the air insertion channel, because the fuzzy end interferes with a proper weft thread insertion and transportation through the channel.

OBJECTS OF THE INVENTION

In view of the above it is the aim of the invention to achieve the following objects singly or in combination:

to present the weft thread to the cutter in a loom so that the weft thread is sufficiently tensioned at the point of cutting;

to present the weft thread to the cutter so that the thread extends substantially at a right axle across the scissors blade;

to assure a clean cut for all types of yarns and for all types of yarn qualities so that fuzzy cut ends are avoided;

to avoid the above mentioned fluttering movement of the weft thread, especially at the time of cutting;

to assure that the cutting takes place when an optimal tension is applied to the weft thread, that is when the slay has already turned and is moving back into the weft thread insertion position; and to control the tension applied to the weft thread by the motion of the slay back into the insertion position and/or by the motion of a thread guide member in a direction opposite to the return movement of the slay.

SUMMARY OF THE INVENTION

According to the invention a guide mechanism for presenting a weft thread to a cutter in a loom is arranged so that its weft thread guide member can be brought into a position in which it holds back the movement of the weft thread when the respective main nozzle is on its way out of the beat-up position back into the weft thread insertion position. Thus, the cutting takes place when the loom slay is on its way back into the insertion position. The weft thread guide member is moved out of the path of the weft thread during the beat-up motion and into the path of the return motion. Preferably, the guide member is movable vertically up and down in synchronism with the motion of the loom slay. Stated differently, the guide member is moved down when the slay and the main nozzle are in the beat-up position. The guide member is held in the down position while the slay is on its return movement so that the weft thread that has not yet been cut is passively held back by the guide member while the slay and the main nozzle keep moving into the insertion position, whereby this movement of the main nozzle in combination with the retention by the guide member apply tension to the weft thread. In its down position the guide member retains the weft thread so that it extends substantially in parallel to the weft thread insertion direction and thus substantially perpendicularly to the cutting edges of the scissors. As mentioned above, presentation of the weft thread perpendicularly to the scissors cutting edges was difficult, if not impossible to be accomplished in prior art air jet looms.

It is important, according to the invention, that the cutting does not take place at the point of return of the loom slay, but rather at a time during the return movement, so that the return movement can be utilized to tension the weft thread against the resistance of the weft thread guide member positioned as taught herein in the return path of the weft thread.

The proper tensioning can be controlled, and hence it can be adapted to the different yarn characteristics by the lowermost position of the weft thread guide member relative to the beat-up line or return point of the slay. The operation of the scissors will be synchronized with the return motion of the slay so that cutting takes place when the tension on the weft thread is optimal. The guide member, for example, in the form of a cylindrical pin, also makes sure that the weft thread cannot slip under the cutter.

The drive mechanism for the weft thread guide pin is preferably an eccentric cam cooperating with a cam follower roller which in turn operates a linkage to which the guide member is either rigidly connected, or to which the guide member is journalled. When the guide member is rigidly connected to the guide linkage, it can perform only a substantially up and down movement. When the guide member is journalled to its drive linkage, a horizontal movement may be superimposed onto the vertical movement, so that the tensioning of the weft thread can be controlled even better by the backward movement of the slay and main nozzle, as well as by the horizontal forward movement of the weft thread guide member.

Preferably, the lower end of the guide member has a hook-type end to positively engage the weft thread for holding the weft thread at a defined level in the vertical direction. Preferably, this vertical level coincides with the level of the stationary cutting edge of the scissors.

In all embodiments the weft thread guide member is lowered into the effective position only when the slay is on its return motion. At all other times, the guide member is withdrawn from the operative position. The guide member is held in the operative position for a short period of time, which begins slightly prior to the cutting and ends right after the cutting.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
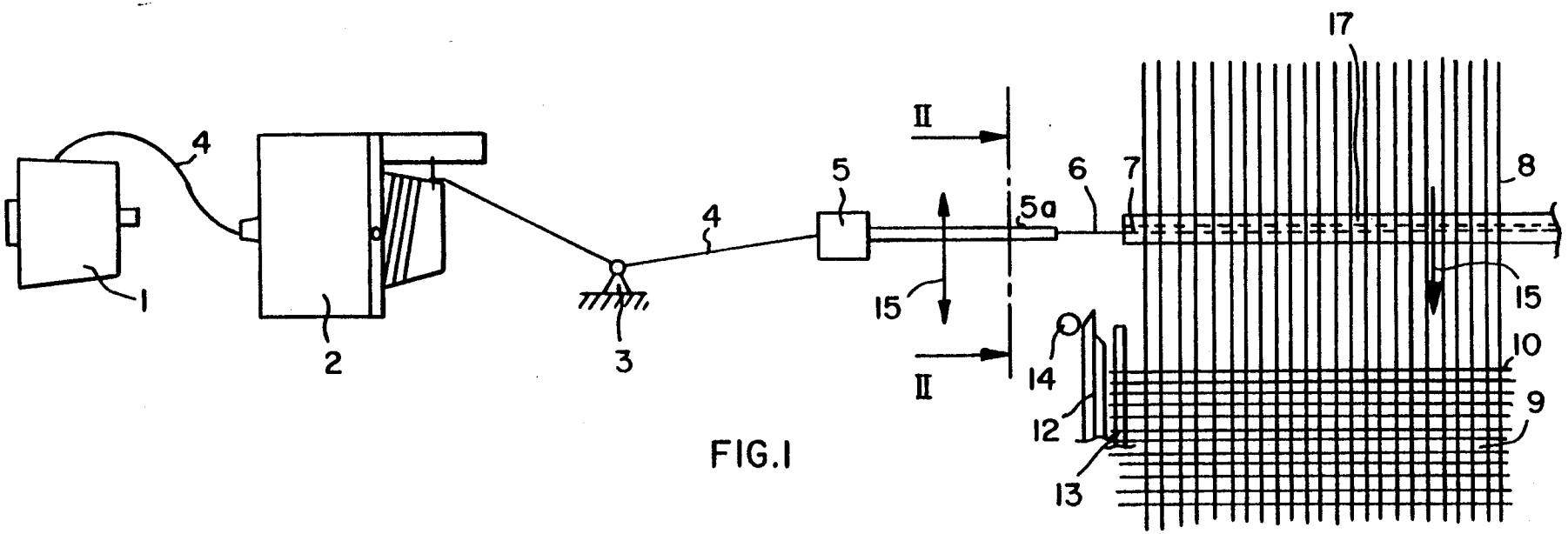
FIG. 1 is a schematic plan view of the loom shed at its weft thread insertion side, whereby the main weft thread insertion nozzle is shown in its weft thread inserting position and the loom slay is not shown.
Figure 2:
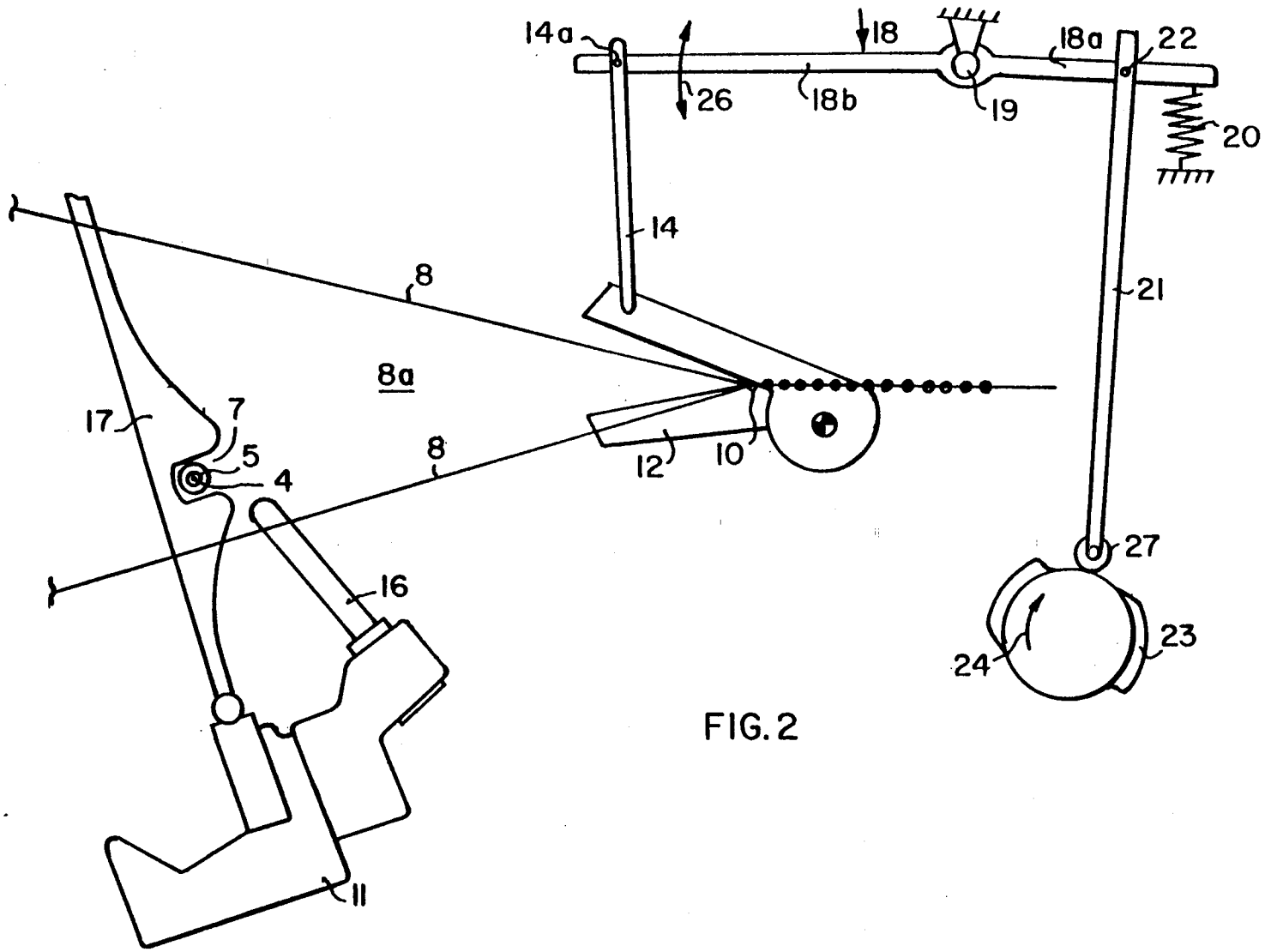
FIG. 2 is a view in the direction of the arrows II—II showing the loom slay in its weft thread inserting position and illustrating the present weft thread guide member in its inoperative, withdrawn position.

Referring to FIG. 1 a weft thread 4 is withdrawn from a supply spool and passes through a weft thread storage 2, through a weft thread guide eye 3, and into the weft thread main insertion nozzle 5 having a nozzle end 5*a*. A weft thread section 6 extends between the end 5*a* and an entrance into the weft thread insertion channel 7 formed by the reed 17. A loom shed is formed by the warp threads 8. The main air jet nozzle 5 is secured to the loom slay 11 as shown in FIG. 2. Relay nozzles 16 cooperate with the main nozzle 5 in transporting the weft thread through the insertion channel 7. The reed 17 is also mounted on the loom slay. The just mentioned components are movable back and forth as shown by the double arrow 15 in FIG. 1 for transporting the slay and the reed between the insertion position shown in FIG. 1 and the beat-up position shown in FIG. 3.

FIG. 2 shows the beat-up point or line 10 of the fabric 9. Upper and lower warp threads 8 form the loom shed 8*a*. The main air jet insertion nozzle 5 is merely shown symbolically in its weft thread inserting position for transporting the weft thread 4 into the air channel 7 formed by the reed 17. Scissors 12 are positioned to cut the weft thread substantially at the beat-up line 10 after the warp threads have changed position and the weft thread has been bound into the fabric. A weft thread guide member 14, for example, in the form of a pin, is so arranged and driven in synchronism with the beat-up motion of the slay 11, that the guide pin 14 can move into the path of the weft thread when the slay is on its return movement from the beat-up position into the insertion position. FIGS. 1 and 2 show the insertion position of the slay 11. Relay nozzles 16 are also mounted to the slay 11 just as the main nozzle 5, so that all nozzles move together with the slay 11. In the insertion position the pulling tension applied to the weft thread by the main nozzle 5 and the auxiliary or relay nozzle 16 transports the weft thread through the channel 7. FIG. 2 further shows that the scissors 12 is open prior to a cutting operation and that the weft thread guide pin 14 is also in an inoperative upward position.

The weft thread guide pin 14 according to the invention is driven by a cam drive 23 rotating in the direction of the arrow 24. The driving force is transmitted from the cam drive 23 to the guide pin 14 through a cam follower 27 operating a linkage including a drive rod 21 and a "see-saw" member 18. The cam follower 27 is rotatably secured to the lower end of the drive rod 21, the upper end of which is jornalled at 22 to one arm 18*a* of the member 18. The free end of the arm 18*a* is biased by a spring 20 against the machine frame. The spring 20 is, for example, a tension spring which biases the cam follower 27 into cooperation with the cam drive 23. The member 18 is journalled at 19 to a fixed machine frame bearing. The upper end of the weft thread guide pin 14 is rigidly secured at 14*a* to the free end of the arm 18*b*. Thus, when the cam drive 23 rotates, the guide pin 14 moves up and down as indicated by the arrow 26. The driving of the cam drive 23 is derived from the main drive shaft of the loom and synchronized with the operation of the slay 11. As shown in FIG. 2, when the slay 11 is in the insertion position, the guide pin 14 is in its inactive upper position in which it cannot engage the weft thread, because the cam follower 27 engages a low portion of the cam drive 23. The pin 14 will move downwardly when the follower 27 engages a high portion of the cam drive 23.

Figure 3:
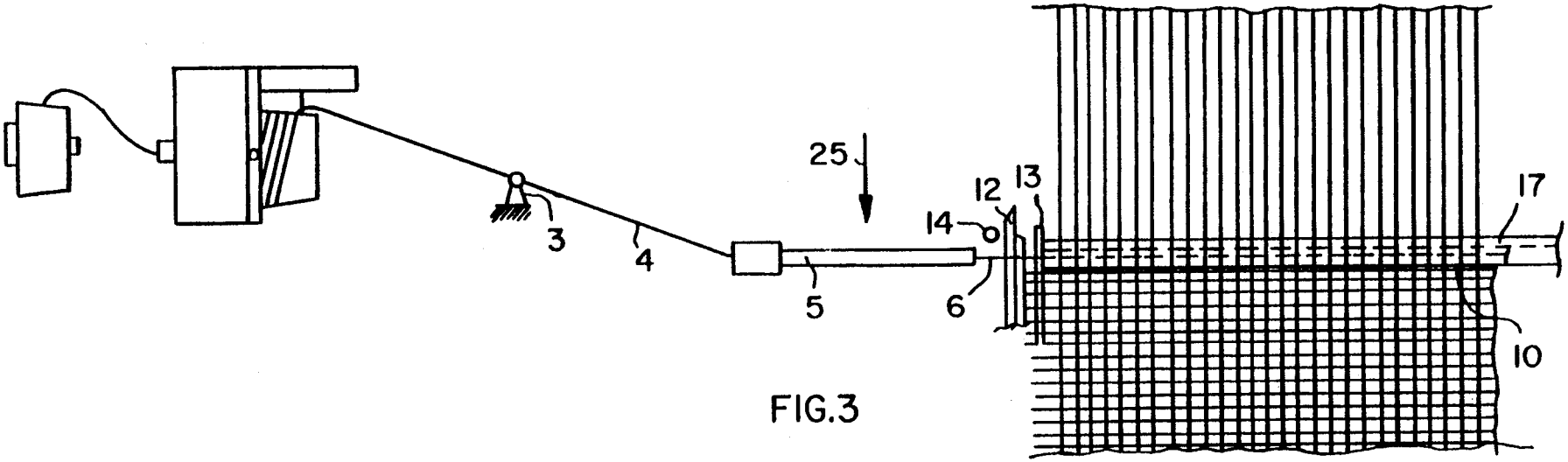
FIG. 3 is a view similar to that of FIG. 1, but showing the main weft thread insertion nozzle in a position in alignment with the beat-up line and with the weft thread guide member in its operative position.
Figure 4:
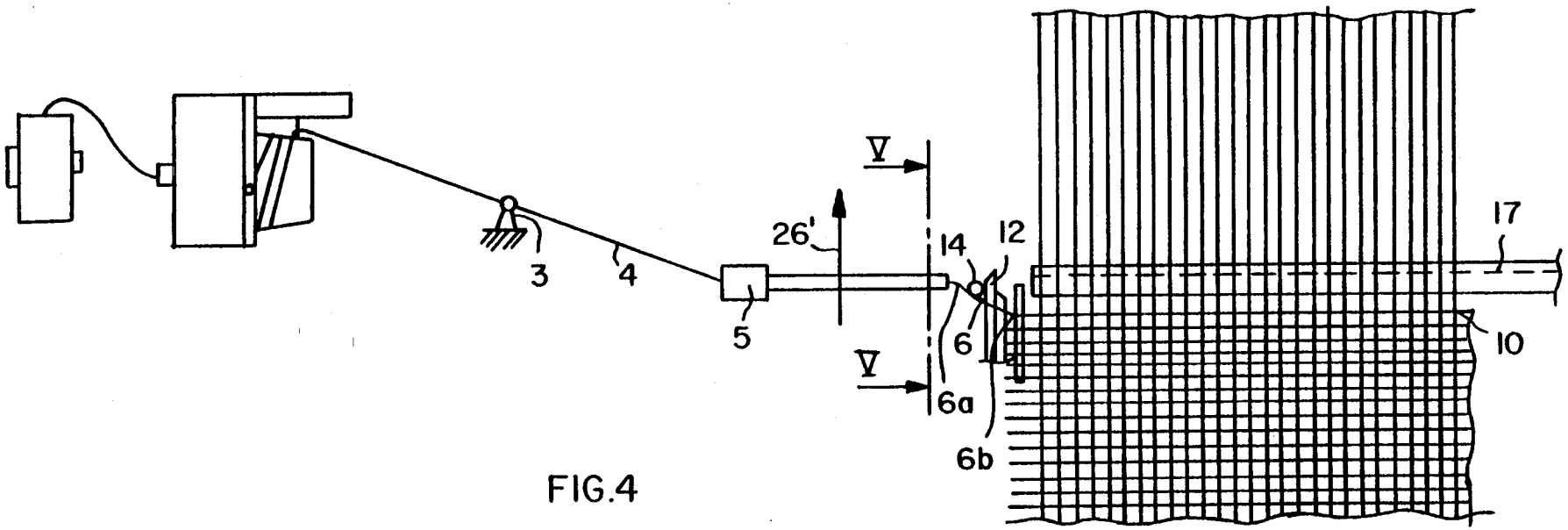
FIG. 4 is a view similar to that of FIG. 3, however with the main weft thread insertion nozzle on its way back into the weft thread insertion position, and showing the cutter in the cutting position.

Referring to FIG. 3, the main nozzle 5 that moved in the direction of the arrow 25 has reached together with the slay 11, that is not shown in FIG. 3, the beat-up position. FIG. 4 shows the slay 11 and thus the main nozzle 5 on their way back into the insertion position as indicated by the arrow 26'. The double arrow 15 in FIG. 1 represents the back and forth movements of the slay 11 and of the main nozzle 5.

As the slay moves from the FIG. 1 position into the FIG. 3 position, the loom shed 8*a* has changed so that the weft thread 4 is now tightly bound in the fabric 9 at the beat-up line 10. At this time the section 6 of the weft thread enters into the operating range of the scissors 12. A conventional clamping bail 13 shown in FIGS. 1, 3, and 4, holds the beat-up weft thread between the scissors 12 and the edge of the fabric 9. The weft thread guide member 14 shown as a circle in FIGS. 3 and 4 has moved to its operating position just slightly to the left of the scissors. In this position the guide member or guide pin 14 can hold the section 6 of the weft thread back as the main nozzle 5 begins its return movement shown in FIG. 4 by the arrow 26' thereby passively stretching the weft thread into a cutting position.

Although FIG. 2 shows the movement of the guide pin 14 downwardly, the same function can be obtained if the guide pin 14 moves upwardly into the operating position. Similarly, the movement of the guide pin 14 does not need to be substantially vertical. Any movement of the guide pin bringing the guide pin into a position in which it is capable to hold back the weft thread section 6 as the nozzle 5 is returning to the insertion position, will be able to perform the intended function of applying the required tension to the weft thread section 6 to perform a clean cut by the scissors 12.

Conventionally, it was customary to cut the weft thread section 6 in the position shown in FIG. 3. However, according to the invention, the cutting takes place slightly later as shown in FIG. 4 when the pin 14 is able to increase the tension on the weft thread sections 6*a* and 6*b* upstream and downstream of the pin 14. Due to the movement of the main nozzle 5 in the direction of the arrow 26' and due to the stationary position of the pin 14 at this time, the tension on the weft thread is increased, whereby the weft thread section 6 is slightly bent as indicated by the thread sections 6*a* and 6*b* in FIG. 4.

The pin 14 is so positioned according to the invention that the section 6*b* remains as straight as possible, or rather in alignment with the beat-up portion of the weft thread while the portion 6*a* bends more and more around the pin 14 as the nozzle 5 moves in the direction of the arrow 26'. It is preferred that the section 6*b* remains straight, because such straightness of the weft thread across the cutting edges of the scissors 12 improves the cut. However, due to the increased tension, it has been found that even the section 6*b* could be slightly slanted if desired. This slant depends on the position of the pin 14 and on the control of the pin 14. As a result, the pin 14 can exactly define the cutting position of the thread relative to the scissors and the operation of the scissors 12 can be controlled accordingly.

According to the invention the cutting takes place in the position of the weft thread shown in FIG. 4, wherein, prior to the cut the thread tension keeps increasing as the nozzle 5 moves back in the direction of the arrow 26'. The invention achieves a precise cut and a clean cut so that fuzzy ends of the cut thread are avoided. Since, as mentioned, the tension increases prior to the cutting it is now possible to select the optimal tension for each type of thread by properly timing the operation of the scissors in response to the movement of the slay 11 and thus of the movement of the nozzle 5. According to the invention, the thread will be preferably cut at a time just prior to a time when the tension would cause the thread to be torn. In any event, the cutting will also take into account that plastic deformations of the threads are avoided.

Figures 5, 6:
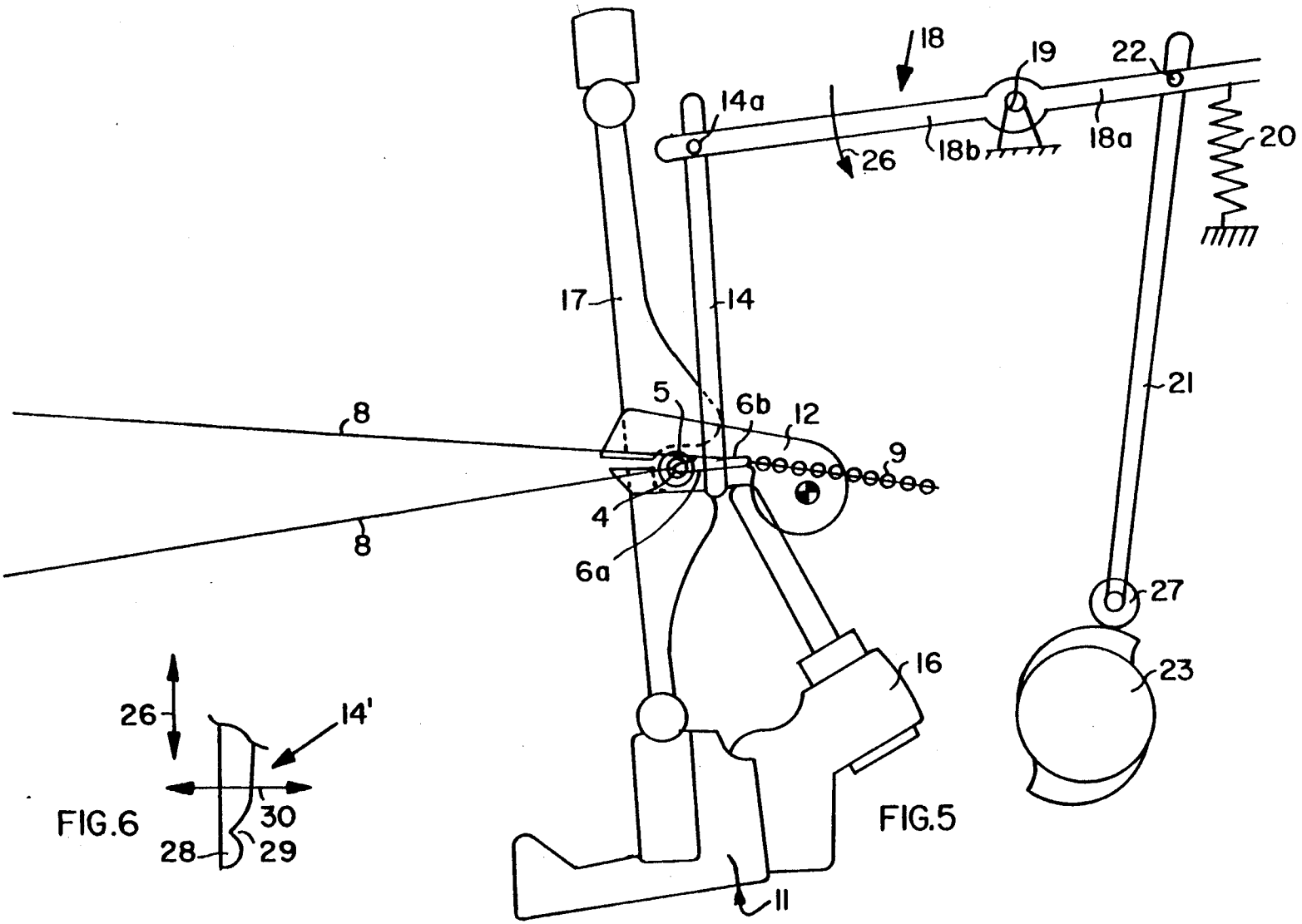
FIG. 5 is a side view, also in the direction of the arrows II—II in FIG. 1, however, now showing a position of the loom slay moving on its way back into the insertion position and showing the cutter in operation.
FIG. 6 shows an enlarged lower end view of a modified embodiment of a weft thread guide member.

FIG. 5 shows the scissors 12 as it performs its cutting operation on the weft thread section 6*b* that is now held substantially straight by the guide pin 14 which simultaneously keeps the thread tensioned until it is cut. The above described drive mechanism for the pin 14 has lowered the pin as shown in FIG. 5. As soon as the cam follower 27 reaches a low area on the cam drive 23, the spring 20 will return the pin 14 into its upper rest position opposite to the direction of the arrow 26. Once the cut is completed, the scissors 12 open and the slay 11 continues to move into its position for the next weft thread insertion into the air channel 7.

Figure 7:
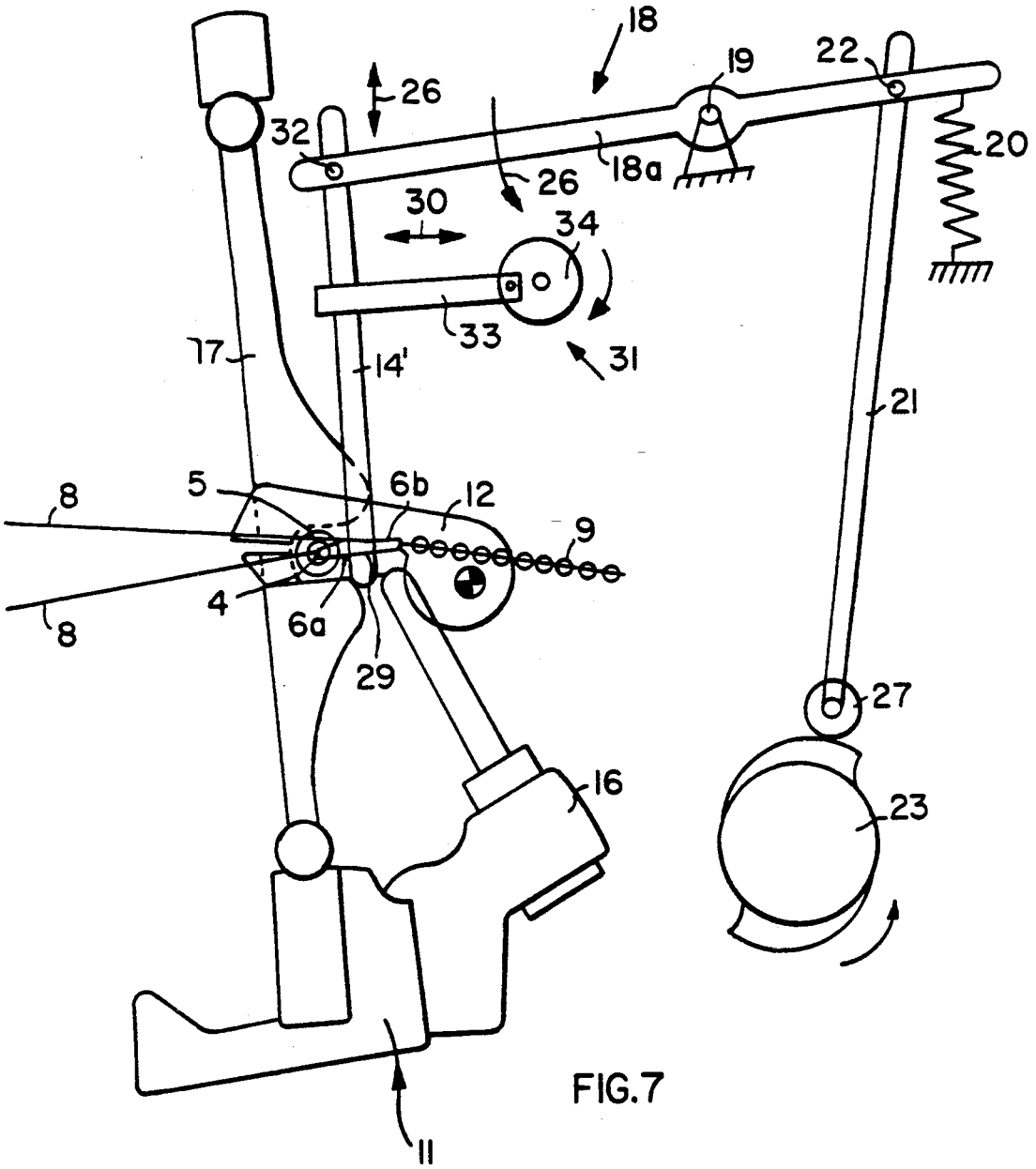
FIG. 7 is a view similar to that of FIG. 5, but showing a drive mechanism for the weft thread guide member capable to impart a composite motion to the guide member, namely an up and down motion and a horizontal back and forth motion.

FIG. 6 shows a guide pin 14', the operating end 28 of which is provided with a notch 29. Such a guide pin 14' is especially suitable for use in an embodiment as shown in FIG. 7, where the above described drive means for the up and down movement of the pin 14 are supplemented by drive means 31 which superimpose on the up and down movement 26 a horizontal back and forth movement as indicated by the arrow 30. For this purpose, the free end of the arm 18*a* of the see-saw member 18 is not rigidly connected to the upper end of the pin 14'. Rather, the connection at 32 in FIG. 7 is a pivoting or journalling connection to permit the pin 14' to move in accordance with the drive imparted to the pin 14' by a pin leader 33 driven, for example, by a crank drive 34. Otherwise the construction in FIG. 7 is the same as described above with reference to the other Figs.

The invention has the advantage that a substantially improved cutting quality of the weft thread is achieved so that the cut ends are not fuzzy, but clean cut. This clean cut is assured by bringing the pin 14, 14' into the path of the returning weft thread at the correct timing as set forth above. The hook type pin end shown in FIG. 6 has the advantage that the pin can hold the weft thread at the desired vertical level in addition to the desired horizontal position thereby pinpointing the weft thread section to be cut, in the exact position for the cutting operation by the scissors 12. Additionally, the embodiment of FIG. 7 also imparts controllable tension to the weft thread prior to the cutting as the pin 14' moves to the right while the nozzle 5 is on its way to the left in FIG. 7, whereby pin 14' actively stretches the weft thread prior to cutting.

Although the above description of the Figs. mentions but one main nozzle 5, the present weft thread guide mechanism functions equally in connection with looms having a plurality of main nozzles or nozzle sections, for example, for transporting four or six weft threads either simultaneously or sequentially for insertion into the channel 7.

Although the invention has been described with reference to specific example embodiments it will be appreciated that it intended to cover all modifications and equivalents within the scope of the appended claims.

What I claimed is:

1. A guide mechanism for presenting a weft thread to a weft thread cutter in a loom, comprising a weft thread guide member, drive means operatively connected to said weft thread guide member for temporarily moving said weft thread guide member into a temporary operative position between said weft thread cutter and a weft thread inserting means on a weft thread inserting side of said loom, said drive means positioning said weft thread guide member in said temporary operative position so that said weft thread is passively stretched into a cutting position by said weft thread guide member, as a loom slay moving back into its weft thread insertion position pulls said weft thread against said weft thread guide member in its operative position.

2. The guide mechanism of claim 1, wherein said loom is an air jet loom, and wherein said weft thread inserting means comprise nozzle means for inserting weft threads into an air guide channel formed in a reed.

3. The guide mechanism of claim 1, wherein said drive means comprise a cam drive, cam follower means driven by said cam drive, and link means interconnecting said weft thread guide member with said cam follower means.

4. The guide mechanism of claim 3, wherein said weft thread guide pin is cylindrical.

5. The guide mechanism of claim 3, wherein said weft thread guide member comprises a substantially vertically extending pin connected with its upper end to said link means for performing a substantially vertical up and down movement between an uppermost pin position and a lowermost pin position in response to rotation of said cam drive, so that said pin in said uppermost pin position is outside a path of the weft thread during its beat-up motion and so that said pin in said lowermost pin position is in the path of the weft thread when said weft thread inserting means are on a return motion following a beat-up motion.

6. The guide mechanism of claim 5, wherein said substantially vertical pin in its lowermost position presents the weft thread substantially at a right angle relative to said cutter, and wherein said weft thread inserting means on its return stroke increases tension on said weft thread prior to a cutting operation.

7. The guide mechanism of claim 4, wherein said pin is rigidly connected at its upper end to said link means.

8. The guide mechanism of claim 4, wherein said weft thread guide pin is journalled at its upper end to said link means, said guide mechanism further comprising a pin leader for imparting to said weft thread guide pin a horizontal movement in addition to said substantially vertical up and down movement, said horizontal movement of said weft thread guide pin actively stretching said weft thread prior to a cutting operation.

9. The guide mechanism of claim 1, wherein said weft thread guide member includes a hook type recess at its lower end for engaging said weft thread, said drive means operating said weft thread guide member for positioning said weft thread at a defined level for said cutter.

* * * * *